US006085544A

United States Patent [19]

Sonnekalb et al.

[11] Patent Number: 6,085,544

[45] Date of Patent: Jul. 11, 2000

[54] COMPRESSION REFRIGERATION UNIT

[75] Inventors: Michael Sonnekalb; Jurgen Kohler, both of Schwalmstadt, Germany

[73] Assignee: Konvekta AG, Schwalmstadt, Germany

[21] Appl. No.: 09/119,484

[22] Filed: Jul. 20, 1998

[51] Int. Cl.[7] ..... F25B 1/00; F25B 4/00

[52] U.S. Cl. ..... 62/498; 62/114

[58] Field of Search ..... 62/498, 114, 115, 62/513

[56] References Cited

U.S. PATENT DOCUMENTS 63,413 4/1867 Lowe ..... 62/114
5,655,378 8/1997 Pettersen ..... 62/498 X

FOREIGN PATENT DOCUMENTS

WO 90/07683 7/1990 WIPO .
WO 94/14016 6/1994 WIPO .

*Primary Examiner*—William Wayner
*Attorney, Agent, or Firm*—Arthur F. Zobal

[57] ABSTRACT

The compression refrigeration unit includes a compressor, a gas refrigeration unit, an expansion apparatus, and an evaporator, which are connected to one another in a circulation system, which contains a coolant, characterized in that the degree of filling of the coolant is between 50% and 100% of the critical density of the coolant. Preferably the coolant is carbon dioxide and the degree of filling of the carbon dioxide coolant is between 0.25 and 0.45 kg/L. Also provided, in another embodiment, is an intermediate heat exchanger with a first heat exchanger branch and a second heat exchanger branch, connected to the first heat exchanger branch by a thermic coupling, wherein the first heat exchanger branch is connected to the gas refrigeration unit and the expansion apparatus and the second heat exchanger branch are connected to the evaporator and the compressor.

5 Claims, 2 Drawing Sheets

COMPRESSION REFRIGERATION UNIT

BACKGROUND OF THE INVENTION

FIELD OF THE INVENTION

The invention concerns a compression refrigeration unit with a compressor, a gas refrigeration unit, an expansion apparatus, and an evaporator, which are connected to one another in a circulation unit, which contains a coolant.

Such a compression refrigeration unit is, for example, known from WO 90/07683. This known unit is constructed as a transcritical unit—that is, it has a transcritical design. Carbon dioxide is used as a coolant.

A compression refrigeration unit of the initially mentioned type is also known from WO 94/14016. This known unit also works transcritically with carbon dioxide as a coolant.

In order to attain a maximum refrigerating capacity co-efficient with these known transcritical compression refrigeration units, the coolant pressure on the high pressure side is set in a precisely suitable manner within relatively narrow limits. That is attained in accordance with the aforementioned WO 94/14016 by setting the degree of filling of the coolant, which is defined as the quotient of the coolant filling to the total volume in the unit, at a value between 0.55 and 0.70 kg/L in the unit, preferably at 0.60 kg/L. The critical density of carbon dioxide as the coolant is 466 g/L—that is, with this known unit, the degree of filling of the coolant is on the order of 120% to 150%, preferably, on the order of 130% of the critical density. As a result of this degree-of-filling range, there is a maximum of the refrigerating capacity co-efficient with the known transcritical unit in accordance with WO 94/14016. In order to be able to maintain this high degree of filling of the coolant optimally with various average external temperatures at which the unit is used, the proposal is made there that the compression refrigeration unit be constructed with an additional coolant storage unit. The storage unit there is also used to hold excess carbon dioxide when a certain pressure at rest is exceeded on the low pressure side of the unit—for example, with a shutdown in a hot environment. The pressure at rest with a degree of filling f=0.60 k/L is 155 bar at, for example, 60° C.—that is, with a motor vehicle standing in the sun or with a hot engine space.

The goal of the invention is to produce a compression refrigeration unit of the initially mentioned type which is constructed in a comparatively simple manner and which can be used in a relatively large external temperature range without any problems, without substantially impairing the refrigerating capacity co-efficient of the unit thereby.

This goal is attained with a compression refrigeration unit of the initially mentioned type in accordance with the invention by having the degree of filling of the coolant between 50% and 100% of the critical density of the coolant. The pressure at rest of the unit in accordance with the invention is only approximately 105 bar, at, for example, 60° C. and a degree of filling f=0.3 kg/L, corresponding to approximately ⅔ of the degree of filling of known units of the initially mentioned type. This means that, advantageously, as a result of the reduced pressure, fewer compressor shaft seals, for example, are required and thus can be more simply dimensioned. Carbon dioxide is preferably used as a coolant. Carbon dioxide is advantageously equivalent to waste in industrial production and is thus available at a very low cost. Carbon dioxide, in fact, has been known as a coolant already since the transition from the 19th to the 20th century.

With the unit in accordance with the invention, the degree of filling of the carbon dioxide coolant is preferably between 0.25 and 0.45 kg carbon dioxide/L total volume of the cyclic process unit. The degree of filling of the unit is actually constant in accordance with the invention. The degree of filling can be set hereby as a function of the average external temperature of the climatic region in which the unit in accordance with the invention is used. This means that the degree of filling can be selected greater with increasing external or ambient temperature.

Preferably, the compression refrigeration unit in accordance with the invention is constructed transcritically. Of course, the unit in accordance with the invention can also be operated subcritically.

Other details, features, and advantages can be deduced from the following description of the embodiment examples of the compression refrigeration unit in accordance with the invention, indicated schematically in the drawings. It shows:

DESCRIPTION OF THE PREFERRED EMBODIMENTS

Figure 1:
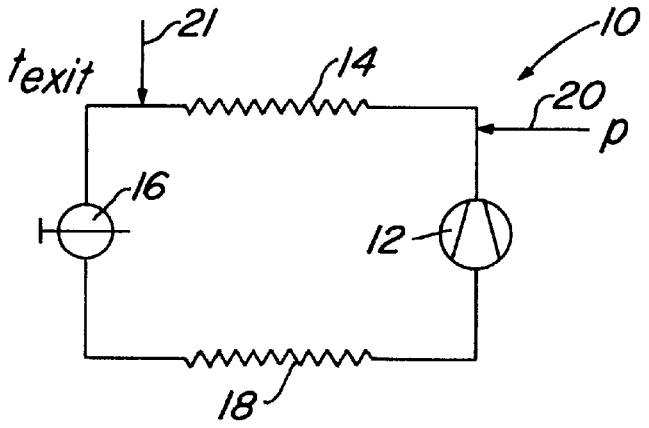
FIG. 1, a diagrammatic representation of an initial development of the compression refrigeration unit.

In a wiring diagram representation, FIG. 1 schematically indicates a refinement of the compression refrigeration unit 10 with a compressor 12, a gas refrigeration unit 14 or condenser, connected to the compressor 12, an expansion apparatus 16 connected to the gas refrigeration unit 14, and an evaporator 18. The compressor 12, the gas refrigeration unit 14, the expansion apparatus 16 and the evaporator 18 are connected to one another in a circulation system. A coolant is contained in the circulation system; the coolant is preferably carbon dioxide.

Figure 2:
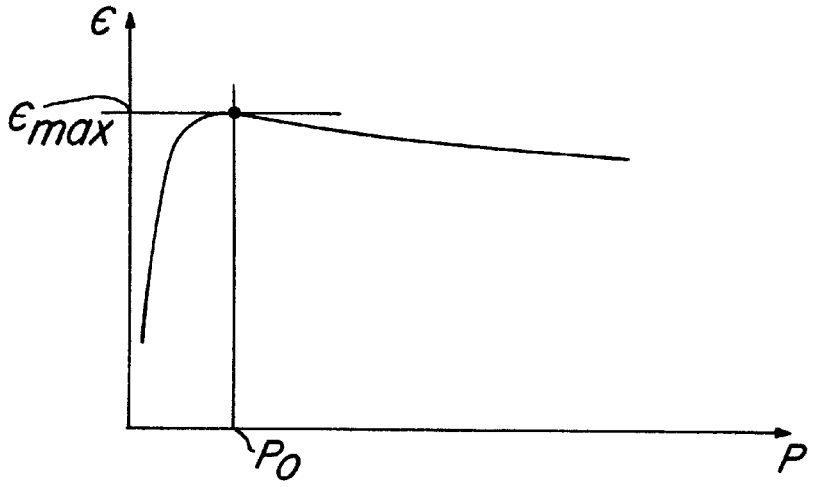
FIG. 2, in diagrammatic representation, the relationship between the refrigeration capacity co-efficient $\in$, and the pressure on the high pressures side of the unit according to FIG. 1.

FIG. 2 illustrates the functional relationship between the refrigeration capacity co-efficient $\in$, of the unit 10 as a function of the high pressure-side pressure p on the compressor 12 or on the entry side of the gas refrigeration unit 14, correlated to the compressor 12. That is indicated in FIG. 1 by the arrow 20, in combination with the symbol p for the aforementioned pressure. One can see from FIG. 2 that the refrigeration capacity co-efficient $\in$, has a maximum $E_{max}$ with a certain pressure $p_o$. That is attained by a certain degree of coolant filling f, which, as was stated above, is between 0.55 and 0.70 kg/L, preferably 0.60 kg/L, according to WO 94/14016. FIG. 2, however, also illustrates that the refrigeration capacity co-efficient $\in$ does not decline substantially below the maximum value $E_{max}$ with pressures p greater than pot The invention under consideration utilizes this. In accordance with the invention, the degree of filling f is selected substantially smaller than was described above.

Figure 3:
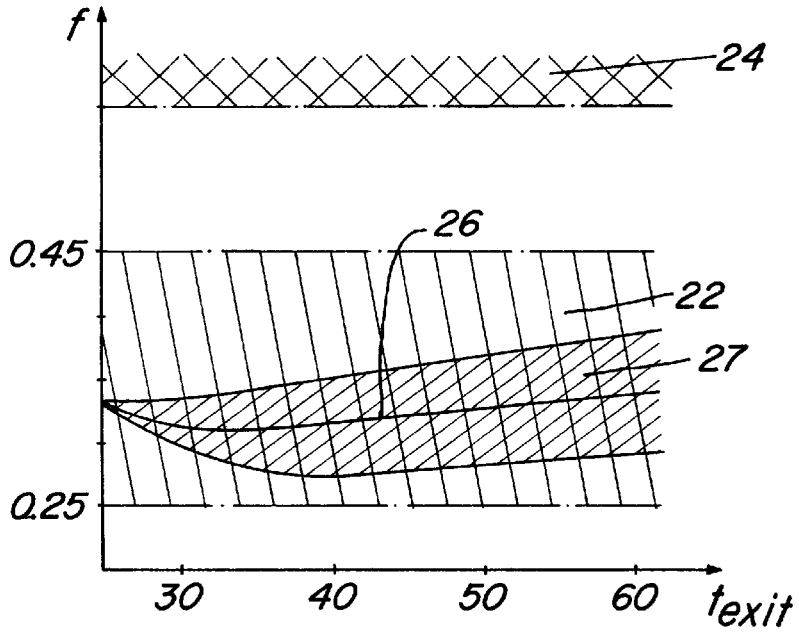
FIG. 3, the functional relationship between the degree of coolant filling f and the exit temperature $t_{exit}$ of the coolant at the outlet of the gas refrigeration unit of the compression refrigeration unit known, for example, from the aforementioned WO 94/14016, in comparison with the unit in accordance with the invention.

This is illustrated by FIG. 3, in which the degree of filling f is illustrated via the gas refrigeration unit exit temperature $t_{exit}$. The gas refrigeration unit exit temperature, whose measurement site is illustrated in FIG. 1 by the arrow 21 in combination with the designation $t_{exit}$, is normally on the order of 5 to 15 K above the ambient temperature and is dependent on the compression rpm, etc. As can be seen from FIG. 3, the degree of coolant filling f of the unit in accordance with the invention 10 (see FIG. 1) is in the range of 0.25 to 0.45 kg carbon dioxide/L total volume of the unit 10. This degree-of-filling range in accordance with the invention is illustrated as a shaded area 22 in FIG. 3. FIG. 3 also illustrates the degree-of-filling range according to compression refrigeration unit as is disclosed in WO 94/14016. This degree-of-filling range is indicated as cross-hatched area 24. It can be seen that the two degree-of-filling ranges 22, 24 have no commonality. FIG. 3 also illustrates, in one line 26, the functional composition f ($t_{exit}$) of the optimal high pressure p, converted into an optimal degree of filling f or a bandwidth for the degree of filling f. Line 26 illustrates that the course of line 26 is very flat above the critical temperature of 31° C. Furthermore, the bandwidth 27 for a refrigeration capacity co-efficient decline of a maximum 5%, illustrated as the shading between two broken lines, increases with increasing temperature $t_{exit}$. Other design points lead to completely similar curves for optimal high pressure and degree of filling. The individual volume divisions in the unit 10 lead to corresponding shifts of the level of the course of the degree of filling, wherein the slopes, however, are similar. The volume of the pressure and the suction lines bring about a drop in the optimal degree of filling. Optimal degrees of filling below 0.25 kg/L are very improbable. An internal, that is, an intermediate heat exchanger 28 for subsequent cooling on the high pressure side and for overheating on the low pressure side, as shown schematically in FIG. 4, leads to higher optimal degrees of filling. An increase in the volume of the gas refrigeration unit 14 has the same effect. Optimal degrees of filling f above 0.45 kg/L are also very improbable.

One can see from the course of the degree of filling that the transcritical refrigeration process can be operated well with a constant degree of filling with only relatively low energy losses. With subcritical temperatures—that is, in the normal cold vapor process with liquefaction on the high pressure side—the optimal degree of filling is steep and, correspondingly, the tolerance range if very narrow, as FIG. 3 illustrates. In order to compensate for this, a collecting vessel is provided in traditional cold vapor-compression refrigeration units, as was initially mentioned.

Figure 4:
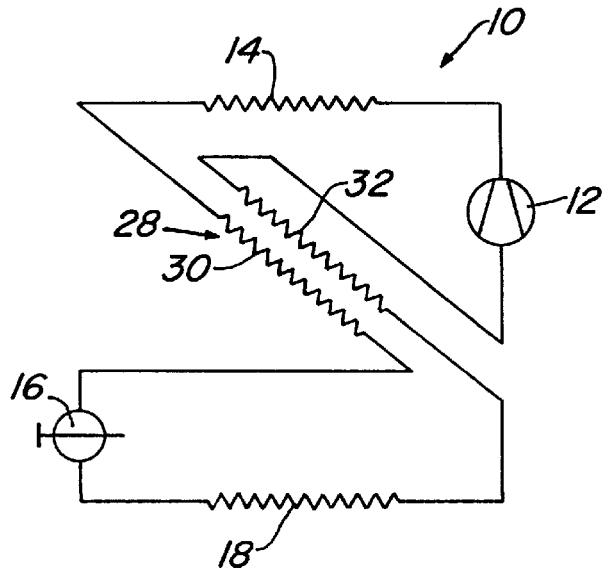
FIG. 4, in a wiring diagram representation similar to FIG. 1, a second specific embodiment of the compression refrigeration unit with an intermediate heat exchanger.

In a schematic wiring diagram, FIG. 4 shows a compression refrigeration unit 10 with a compressor 12, as gas refrigeration unit 14, connected to the compressor, an intermediate heat exchanger 28, an expansion apparatus 16, and an evaporator 18. The intermediate heat exchanger 28 exhibits a first heat exchanger branch 30 and a second heat exchanger branch 32, which are joined to one another by means of a thermic coupling. The first heat exchanger branch 30 is connected between the gas refrigeration unit 14 and the expansion apparatus 16.

The second heat exchanger branch 32 is connected between the evaporator 18 and the compressor 12.

What is claimed is:

1. A compression refrigeration unit comprising a compressor, a gas refrigeration unit, an expansion apparatus, and an evaporator, which are connected to one another in a circulation system, which contains a coolant, characterized in that the degree of filling of said coolant is between 50% and 100% of the critical density of the said coolant.

2. The compression refrigeration unit of claim 1, characterized in that said coolant is carbon dioxide.

3. The compression refrigeration unit according to claim 2, characterized in that the degree of filling of said carbon dioxide coolant is between 0.25 and 0.45 kg/L.

4. The compression refrigeration unit according to one of claims 1, 2, or 3, characterized in that said unit is constructed transcritically.

5. The compression refrigeration unit according to one of claims 1, 2 or 3, comprising an intermediate heat exchanger provided with a first heat exchanger branch and a second heat exchanger branch, connected to said first heat exchanger branch by a thermic coupling, wherein said first heat exchanger branch is connected to said gas refrigeration unit and said expansion apparatus and said second heat exchanger branch are connected to said evaporator and to said compressor.

* * * * *